US006895629B1

(12) United States Patent
Wenzler

(10) Patent No.: US 6,895,629 B1
(45) Date of Patent: May 24, 2005

(54) DOUBLE SIDED TOOTHBRUSH

(76) Inventor: Michael James Wenzler, 1025 W. Rahn, Dayton, OH (US) 45429

( * ) Notice: Subject to any disclaimer, the term of this patent is extended or adjusted under 35 U.S.C. 154(b) by 0 days.

(21) Appl. No.: 10/891,801

(22) Filed: Jul. 15, 2004

(51) Int. Cl.[7] ..... A47L 13/12; A46B 9/04
(52) U.S. Cl. ..... 15/106; 15/167.1; 15/DIG. 5
(58) Field of Search ..... 15/106, 111, 114, 15/167, DIG. 5, 110; 606/161

(56) References Cited

U.S. PATENT DOCUMENTS

| | | | | |
|---|---|---|---|---|
| 1,513,104 A | | 10/1924 | Gracey | |
| 2,599,191 A | * | 6/1952 | Meunier | 15/167.1 |
| 2,697,239 A | | 12/1954 | Funk | |
| 3,337,893 A | * | 8/1967 | Fine et al. | 15/111 |
| 3,939,520 A | | 2/1976 | Axelsson | |
| 4,222,143 A | | 9/1980 | Tarrson et al. | |
| 4,406,032 A | | 9/1983 | Diamant | |
| 4,517,701 A | | 5/1985 | Stanford, Jr. | |
| 4,616,374 A | * | 10/1986 | Novogrodsky | 15/167.1 |
| D291,504 S | | 8/1987 | Tarrson et al. | |
| 4,731,896 A | | 3/1988 | de La Tour | |
| 4,922,936 A | | 5/1990 | Buzzi et al. | |
| 5,544,383 A | * | 8/1996 | Gamble | 15/106 |
| 6,119,296 A | * | 9/2000 | Noe et al. | 15/104.94 |
| 6,260,229 B1 | * | 7/2001 | Edwards et al. | 15/207.2 |
| 2004/0078910 A1 | * | 4/2004 | Grote | 15/106 |

FOREIGN PATENT DOCUMENTS

| | | | |
|---|---|---|---|
| GB | 2 264 864 | * | 9/1993 |

* cited by examiner

*Primary Examiner*—Randall Chin
(74) *Attorney, Agent, or Firm*—R. William Graham

(57) ABSTRACT

A toothbrush has a handle and a head, wherein a plurality of relatively straight bristle fibers extend outward from one side of a bristle-supporting portion of the head to provide a looped coarse scrubbing surface. In addition, a plurality of looped fibers extend outward from another side of a looped fiber-supporting portion of the head, wherein an end of each looped fiber is fixably connected to the fiber supporting surface, wherein the looped fiber has a curved portion most outwardly disposed from the fiber-supporting portion such that there is provided a soft scrubbing lufa like surface.

6 Claims, 1 Drawing Sheet

DOUBLE SIDED TOOTHBRUSH

BACKGROUND OF THE INVENTION

1. Field of the Invention

This invention relates to toothbrushes, particularly in the prevention and treatment of periodontal disease. More specifically, this invention is directed to an improved toothbrush having a unique dual brushing surface.

2. Prior Art

It is well known that brushing one's teeth aids in the prevention of tooth decay and disease. The teeth provide a natural habitat for microbial growth in the fluid environment of the mouth and gingival crevices. Germs and bacteria are also found on the gums as well as the roof of the mouth.

Certain types of microorganisms foster periodontal disease which wear on the gums causing them to gradually separate away from the infected root surfaces. Other problematic germs and bacteria lead to bad breath.

In addition to professional treatment in a dentist's office, it is found beneficial for one to administer self-treatment on a daily basis. Such self-treatment usually includes in addition to tooth brushing, dental flossing, brushing interproximally and rinsing with various antiseptic or antibacterial solutions. Another common treatment in oral hygiene programs used by patients includes gargling with various salts, such as sodium chloride, sodium bicarbonate, etc. which can help to control bacterial activity on root surfaces as well as the mouth. Mouth washing, brushing, flossing or using toothpicks soon after eating reduces bacteria.

Various arrangements have been proposed to modify toothbrushes to facilitate cleaning of the teeth and gums. Such devices are disclosed in U.S. Pat. Nos. 4,517,701 and 4,222,143. One such brush design includes bristles which extend from a head in generally opposite directions. Another design provides for angled bristles. Toothbrush bristles vary in stiffness or combine different stiffness, e.g., one toothbrush includes a group of center bristles with bristles which are softer and longer in order to provide an improved massage of the gums and improve the cleaning of the teeth. Other toothbrushes have curved heads or toothbrush heads with oppositely-disposed bristles. For example, a toothbrush in U.S. Pat. No. 1,513,104 provides a wrap-around arrangement for bristles resulting in the majority of the bristles extending from opposite sides of an oval head. By providing an upwardly-curved portion of the stem, the insides of the teeth can be brushed with the handle held flat and the upwardly-turned portion remaining clear of the front teeth. A curved head toothbrush is described in U.S. Pat. No. 2,697,239 wherein the brush head is arranged transversely to the stem of the toothbrush so that the handle extends outwardly from the mouth perpendicularly to the gum lines of those teeth being brushed.

While there exist prior art toothbrushes which focus on brushing the teeth and gums, there has yet to be provided a toothbrush which includes a dual purpose of comfortably and effectively enabling brushing one's teeth and gums and also the remaining mouth tissue. The present invention achieves this.

SUMMARY OF THE INVENTION

It is an object of the invention to provide and improve cleaning within the mouth, particularly the teeth, gums and inner mouth tissue.

It is another object to provide an improved toothbrush.

Accordingly, the invention is directed to a toothbrush having a handle and a head, wherein a plurality of relatively straight bristle fibers extend outward from one side of a bristle-supporting portion of the head to provide a looped coarse scrubbing surface. In addition, a plurality of looped fibers extend outward from another side of a looped fiber-supporting portion of the head, wherein an end of each looped fiber is fixably connected to the fiber supporting surface, wherein the looped fiber has a curved portion most outwardly disposed from the fiber-supporting portion such that there is provided a soft scrubbing lufa like surface.

The straight bristles can be of varied length to aid in reaching crevices between the teeth and gums. The soft looped fibers can be used to scrub the roof of the mouth as well as the gum areas. The looped fiber supporting portion can be arcuate and can preferably extend beyond 180 degrees and with the looped fibers connected thereto provides for a radial scrubbing surface aspect. The head can be slightly angled with respect to the handle.

DETAILED DESCRIPTION OF THE PREFERRED EMBODIMENTS

Figure 3:
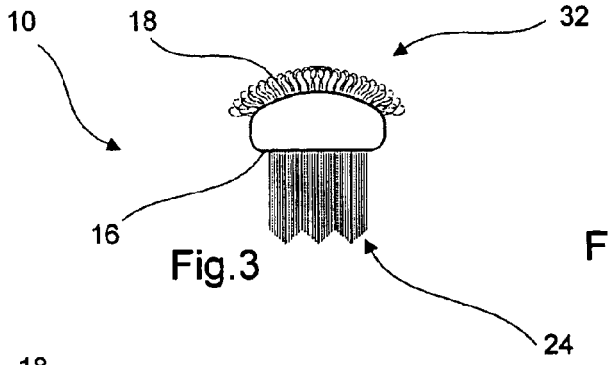
FIG. 3 is an end view of FIG. 1.

Referring now to the drawings, the toothbrush according to the invention is generally designated by the numeral 10. The toothbrush 10 includes a handle 12 and a head 14. The head 14 may be angled with respect to the handle 12 which can be contoured to facilitate improved control of the toothbrush 12 by providing a symmetrical twist in the contour to accommodate the user's thumb and the user's fingers at a desired angle with respect to the head 14 as known in the art.

Figure 2:
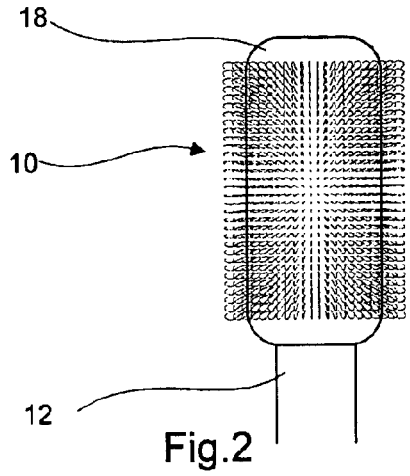
FIG. 2 is a view of one side of the toothbrush of FIG. 1.
Figure 1:
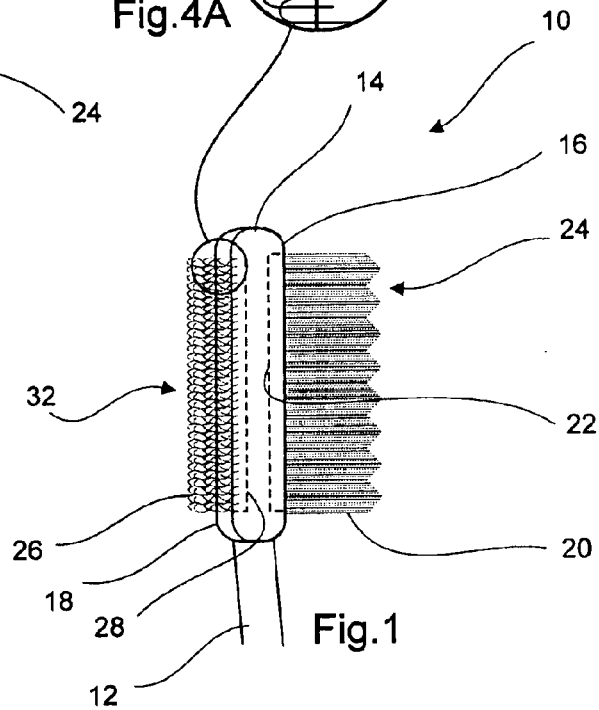
FIG. 1 is a side perspective view of the toothbrush according to one embodiment of the invention.

As is the case with conventional toothbrushes, the handle 12 and the head 14 are preferably molded as a single piece. Referring to FIGS. 1–3, there are two generally oppositely disposed sides 16 and 18, wherein a plurality of relatively straight bristles 20 fibers extend outward from side 16 of a bristle-supporting portion 22 of the head 14 to provide a coarse scrubbing surface 24. The straight bristles 20 can be of varied length to aid in reaching crevices between the teeth and gums.

Figure 4A:
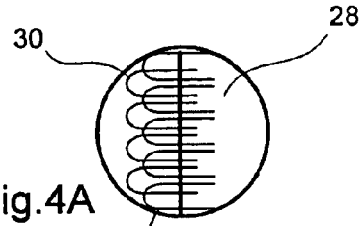
FIG. 4A is a blow up depicting one embodiment of a part of FIG. 1.
Figure 4B:
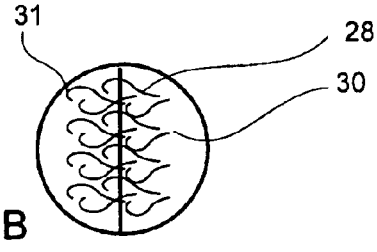
FIG. 4B is a blow up depicting another embodiment of a part of FIG. 1.

A plurality of looped fibers 26 extend outward from side 18 of a fiber-supporting portion 28 of the head 14. As seen in FIG. 4A, both ends 30 of each looped fiber 26 are fixably connected to the fiber supporting portion 28 such that there is provided a soft scrubbing lufa like surface 32 whereas FIG. 4B shows a one end 30 of the fiber 26 connected to the fiber supporting portion 28 with another end 31 formed in a loop yet remaining unconnected. The embodiment in FIG. 4B may provide for easier cleaning of the fibers 26 and better enable cleaning thereof. The soft looped fibers 26 can be used to scrub the roof of one's mouth as well as gum areas and the remaining mouth tissue.

The side 18 including the looped fiber supporting portion 28 can be arcuate and can preferably extend beyond 180 degrees and with the looped fibers 26 connected thereto provides for a radial scrubbing surface 32. The head 14 can be slightly angled with respect to the handle 12 as seen in FIG. 1.

It should be understood that the bristles 20 can be made of various rigidity to achieve a desired stiffness, soft or medium tip bristles 20, in order to facilitate thorough cleaning of the teeth and without lacerating the soft gum tissue. Fibers 26 can preferably be made of soft flexible material to provide the cleaning ability of the mouth roof, for example, without abrasion thereto.

It is also anticipated that the tooth brushes according to this invention would be provided with a stem adapted to mount on conventional motorized (electric) toothbrush handles. This would permit the patient to take advantage of the efficiency of a motorized toothbrush. The head 14 may so configured to be removable from the handle 12 to be changed between brushings, giving the heads 14 a chance to more thoroughly dry and therefore reducing germs and bacteria.

What is claimed is:

1. A toothbrush, comprising:

an elongated handle;

a head connected to said handle having a bristle-supporting portion and an opposing fiber-supporting portion;

a plurality of relatively straight bristle fibers extending outward from said bristle-supporting portion of said head to provide a relatively coarse scrubbing surface; and a plurality of looped fibers extending outward from said fiber-supporting portion of said head, said plurality of looped fibers having a curved outer portion most outwardly disposed from said fiber-supporting portion, wherein an end of each said looped fiber is fixably connected to said fiber supporting portion such that there is provided a soft scrubbing lufa like surface.

2. The toothbrush of claim 1, wherein said straight bristles are of varied length.

3. The toothbrush of claim 1, wherein said looped fiber supporting surface is arcuate.

4. The toothbrush of claim 3, further characterized in that said looped fiber supporting surface extends beyond 180 degrees and with said looped fibers connected thereto provides for a radial scrubbing surface aspect.

5. The toothbrush of claim 1, wherein said head is angled with respect to said handle.

6. The toothbrush of claim 1, wherein said elongated handle is contoured to facilitate improved control of said toothbrush by providing a symmetrical twist in said contour to accommodate the user's thumb and the user's fingers at a desired angle with respect to the bristle-supporting portion.

* * * * *